US011346054B2

(12) United States Patent
Aoyama et al.

(10) Patent No.: US 11,346,054 B2
(45) **Date of Patent: *May 31, 2022**

(54) FIBER BODY FORMING METHOD AND FIBER BODY FORMING APPARATUS

(71) Applicant: SEIKO EPSON CORPORATION, Tokyo (JP)

(72) Inventors: Tetsuya Aoyama, Shiojiri (JP); Shinichi Kato, Matsumoto (JP); Shigemi Wakabayashi, Azumino (JP); Kaneo Yoda, Okaya (JP)

(73) Assignee: SEIKO EPSON CORPORATION, Tokyo (JP)

( * ) Notice: Subject to any disclaimer, the term of this patent is extended or adjusted under 35 U.S.C. 154(b) by 149 days.

This patent is subject to a terminal disclaimer.

(21) Appl. No.: 16/695,261

(22) Filed: Nov. 26, 2019

(65) Prior Publication Data

US 2020/0165780 A1 May 28, 2020

(30) Foreign Application Priority Data

Nov. 27, 2018 (JP) ..... JP2018-221157
Nov. 27, 2018 (JP) ..... JP2018-221158
Feb. 25, 2019 (JP) ..... JP2019-031639

(51) Int. Cl.

| | |
|---|---|
| ***D21H 23/24*** | (2006.01) |
| ***B41M 5/00*** | (2006.01) |
| ***D21H 19/12*** | (2006.01) |
| ***D21H 23/30*** | (2006.01) |
| ***D21H 23/50*** | (2006.01) |
| ***D21H 23/72*** | (2006.01) |

(52) U.S. Cl.

CPC ..... *D21H 23/24* (2013.01); *B41M 5/0035* (2013.01); *D21H 19/12* (2013.01); *D21H 23/30* (2013.01); *D21H 23/50* (2013.01); *D21H 23/72* (2013.01)

(58) Field of Classification Search

USPC ..... 162/164.6

See application file for complete search history.

(56) References Cited

U.S. PATENT DOCUMENTS

| | | | |
|---|---|---|---|
| 3,200,005 | A | 8/1965 | Bauer |
| 3,963,843 | A | 6/1976 | Hitchmough et al. |
| 5,225,047 | A | 7/1993 | Graef et al. |
| 5,252,275 | A | 10/1993 | Sultze et al. |
| 5,437,418 | A | 8/1995 | Graef et al. |
| 5,865,950 | A | 2/1999 | Vinson et al. |
| 5,944,954 | A | 8/1999 | Vinson et al. |
| 6,207,734 | B1 | 3/2001 | Vinson et al. |
| 6,436,231 | B1 | 8/2002 | Graef et al. |
| 6,838,401 | B1 | 1/2005 | Murayama et al. |
| 8,882,965 | B2 | 11/2014 | Yamagami et al. |
| 9,403,393 | B2 | 8/2016 | Aoyama et al. |
| 2005/0249895 | A1 | 11/2005 | Sisler et al. |
| 2006/0038871 | A1 | 2/2006 | Chen et al. |
| 2007/0267163 | A1 | 11/2007 | Tamai et al. |
| 2014/0364548 | A1 | 12/2014 | Everhardus et al. |
| 2015/0091974 | A1 | 4/2015 | Aoyama et al. |
| 2016/0193857 | A1 | 7/2016 | De Mondt et al. |
| 2016/0207307 | A1 | 7/2016 | De Mondt et al. |
| 2016/0375718 | A1 | 12/2016 | Van Garsse et al. |
| 2020/0165781 | A1* | 5/2020 | Aoyama ..... D21H 23/24 |

FOREIGN PATENT DOCUMENTS

| | | | |
|---|---|---|---|
| EP | 1310593 | A1 | 5/2003 |
| EP | 2857213 | A1 | 4/2015 |
| JP | H10-86247 | A | 4/1998 |
| JP | 2003-170579 | A | 6/2003 |
| JP | 2006-002296 | A | 1/2006 |
| JP | 2007-130875 | A | 5/2007 |
| JP | 2010-076118 | A | 4/2010 |
| JP | 2011-212255 | A | 10/2011 |
| JP | 2012-144826 | A | 8/2012 |
| JP | 2013-107221 | A | 6/2013 |
| WO | 93/14264 | A1 | 7/1993 |
| WO | 97/44526 | A1 | 11/1997 |

OTHER PUBLICATIONS

Sep. 11, 2020 Office Action Issued in U.S. Appl. No. 16/695,287.
Sep. 29, 2020 Office Action Issued in U.S. Appl. No. 16/695,527.
Mar. 26, 2021 Notice of Allowance issued in U.S. Appl. No. 16/695,287.
Apr. 5, 2021 Office Action issued in U.S. Appl. No. 16/695,527.
U.S. Appl. No. 16/695,287, filed Nov. 26, 2019 in the name of Aoyama et al.
U.S. Appl. No. 16/695,527, filed Nov. 26, 2019 in the name of Aoyama.
U.S. Appl. No. 16/695,680, filed Nov. 26, 2019 in the name of Aoyama et al.
Dec. 15, 2020 Office Action issued in U.S. Appl. No. 16/695,287.

* cited by examiner

*Primary Examiner* — Mark Halpern
(74) *Attorney, Agent, or Firm* — Oliff PLC

(57) ABSTRACT

A fiber body forming method includes a step of preparing a web which contains fibers and which has a bulk density of 0.09 g/cm$^3$ or more; and a step of applying a liquid containing a binder which binds the fibers together to the web.

11 Claims, 10 Drawing Sheets

| LIQUID | | L1 | L2 | L3 |
|---|---|---|---|---|
| WATER-SOLUBLE RESIN | PVA | 10 | — | — |
| | PAM | — | 10 | — |
| THERMOPLASTIC RESIN | PU | — | — | 10 |
| PENETRANT | E1010 | 0.2 | 0.2 | 0.2 |
| WATER | | BALANCE | BALANCE | BALANCE |
| TOTAL | | 100 | 100 | 100 |

FIG. 13

| | EXAMPLE 1 | EXAMPLE 2 | EXAMPLE 3 | EXAMPLE 4 | EXAMPLE 5 | EXAMPLE 6 | EXAMPLE 7 | EXAMPLE 8 | COMPARATIVE EXAMPLE 1 |
|---|---|---|---|---|---|---|---|---|---|
| PRESSURE [kgf/cm$^2$] | 1 | 3 | 30 | 300 | 500 | 600 | 30 | 30 | — |
| BULK DENSITY [g/cm$^3$] | 0.09 | 0.20 | 0.60 | 0.70 | 0.80 | 0.82 | 0.60 | 0.60 | 0.08 |
| LIQUID | L1 | L1 | L1 | L1 | L1 | L1 | L2 | L3 | L1 |
| INTERLAYER PEELING TEST | B | A | A | A | B | C | A | A | D |
| TENSILE STRENGTH TEST | A | A | A | A | A | C | A | A | D |

FIG. 14

| | EXAMPLE 9 | EXAMPLE 10 | EXAMPLE 11 | EXAMPLE 12 | EXAMPLE 13 | EXAMPLE 14 | EXAMPLE 15 | EXAMPLE 16 | COMPARATIVE EXAMPLE 2 |
|---|---|---|---|---|---|---|---|---|---|
| PRESSURE [kgf/cm$^2$] | 1 | 3 | 30 | 300 | 500 | 600 | 30 | 30 | — |
| BULK DENSITY [g/cm$^3$] | 0.09 | 0.20 | 0.60 | 0.70 | 0.80 | 0.82 | 0.60 | 0.60 | 0.08 |
| LIQUID | L1 | L1 | L1 | L1 | L1 | L1 | L2 | L3 | L1 |
| INTERLAYER PEELING TEST | B | A | A | A | B | C | A | A | D |
| TENSILE STRENGTH TEST | B | A | A | A | B | C | A | A | D |

FIG. 15

| | EXAMPLE 17 | EXAMPLE 18 | EXAMPLE 19 | EXAMPLE 20 | EXAMPLE 21 | EXAMPLE 22 | EXAMPLE 23 | EXAMPLE 24 | COMPARATIVE EXAMPLE 3 |
|---|---|---|---|---|---|---|---|---|---|
| PRESSURE [kgf/cm$^2$] | 1 | 3 | 30 | 300 | 500 | 600 | 30 | 30 | — |
| BULK DENSITY [g/cm$^3$] | 0.09 | 0.20 | 0.60 | 0.70 | 0.80 | 0.82 | 0.60 | 0.60 | 0.08 |
| LIQUID | L1 | L1 | L1 | L1 | L1 | L1 | L2 | L3 | L1 |
| INTERLAYER PEELING TEST | A | A | A | A | A | C | A | A | D |
| TENSILE STRENGTH TEST | A | A | A | A | A | C | A | A | D |

FIBER BODY FORMING METHOD AND FIBER BODY FORMING APPARATUS

The present application is based on, and claims priority from JP Application Serial Number 2018-221158, filed Nov. 27, 2018, JP Application Serial Number 2019-031639, filed Feb. 25, 2019, and JP Application Serial Number 2018-221157, filed Nov. 27, 2018, the disclosures of which are hereby incorporated by reference herein in their entirety.

BACKGROUND

1. Technical Field

The present disclosure relates to a fiber body forming method and a fiber body forming apparatus.

2. Related Art

In order to achieve reduction in size and energy saving, there has been proposed a sheet manufacturing apparatus by a dry system in which the amount of water to be used is decreased as much as possible. For example, JP-A-2012-144826 has disclosed that in a sheet manufacturing apparatus by a dry system, moisture to which a paper strength improver, such as a starch or a poly(vinyl alcohol) (PVA), is added is sprayed on a deposit of deinked fibers deposited on a mesh belt to increase a paper strength.

However, by the method described above, since the bulk density of the deposit deposited on the mesh belt is low, a binder, such as a PVA, which adheres the fibers of the deposit together is not easily infiltrated deeply in the deposit. Hence, insufficient adhesion occurs in the deposit, and for example, when offset printing is performed, interlayer peeling may be generated in a sheet thus formed in some cases.

SUMMARY

A fiber body forming method according to an aspect of the present disclosure comprises: a step of preparing a web which contains fibers and which has a bulk density of 0.09 g/cm$^3$ or more; and a step of applying a liquid containing a binder which binds the fibers together to the web.

A fiber body forming method according to another aspect of the present disclosure comprises: a step of preparing a web which contains fibers; a step of pressurizing the web; and a step of applying a liquid containing a binder which binds the fibers together to the pressurized web.

In the fiber body forming method according to the aspect described above, the binder may be a thermoplastic resin or a thermosetting resin.

In the fiber body forming method according to the aspect described above, the binder may be a water-soluble resin.

The fiber body forming method according to the aspect described above may further comprise a step of heating the web to which the liquid is applied.

The fiber body forming method according to the aspect described above may further comprise a step of pressurizing the web to which the liquid is applied.

In the fiber body forming method according to the aspect described above, in the step of applying a liquid, the liquid may be applied by an ink jet method.

In the fiber body forming method according to the aspect described above, in the step of applying a liquid, the web may have a bulk density of 0.80 g/cm$^3$ or less.

In the fiber body forming method according to the aspect described above, in the step of applying a liquid, the web may have a bulk density of 0.20 to 0.70 g/cm$^3$.

A fiber body forming apparatus according to another aspect of the present disclosure comprises: a liquid application device which applies a liquid to a web which contains fibers and which has a bulk density of 0.09 g/cm$^3$ or more, the liquid containing a binder which binds the fibers together.

A fiber body forming apparatus according to another aspect of the present disclosure comprises: a pressure application portion which pressurizes a web containing fibers; and a liquid application device which applies a liquid to the web pressurized by the pressure application portion, the liquid containing a binder which binds the fibers together.

In the fiber body forming apparatus according to the aspect described above, the binder may be a thermoplastic resin or a thermosetting resin.

In the fiber body forming apparatus according to the aspect described above, the binder may be a water-soluble resin.

The fiber body forming apparatus according to the aspect described above may further comprise a heating portion which heats the web to which the liquid is applied by the liquid application device.

The fiber body forming apparatus according to the aspect described above may further comprise a pressure application portion which pressurizes the web to which the liquid is applied by the liquid application device.

In the fiber body forming apparatus according to the aspect described above, the liquid application device may be an ink jet head.

In the fiber body forming apparatus according to the aspect described above, the web to which the liquid is applied by the liquid application device may have a bulk density of 0.80 g/cm$^3$ or less.

In the fiber body forming apparatus according to the aspect described above, the web to which the liquid is applied by the liquid application device may have a bulk density of 0.20 to 0.70 g/cm$^3$ or less.

BRIEF DESCRIPTION OF THE DRAWINGS

FIG. 13 is a table showing evaluation results of an interlayer peeling test and a tensile strength test of each of Examples 1 to 8 and Comparative Example 1.

FIG. 14 is a table showing evaluation results of the interlayer peeling test and the tensile strength test of each of Examples 9 to 16 and Comparative Example 2.

FIG. 15 is a table showing evaluation results of the interlayer peeling test and the tensile strength test of each of Examples 17 to 24 and Comparative Example 3.

DESCRIPTION OF EXEMPLARY EMBODIMENTS

Hereinafter, preferable embodiments of the present disclosure will be described in detail with reference to the attached drawings. In addition, the following embodiments do not unreasonably limit the contents of the present disclosure described in the claims. In addition, all the elements described below are not always required to be essential constituent elements of the present disclosure.

1. FIBER BODY FORMING APPARATUS

1.1. Structure

Figure 1:
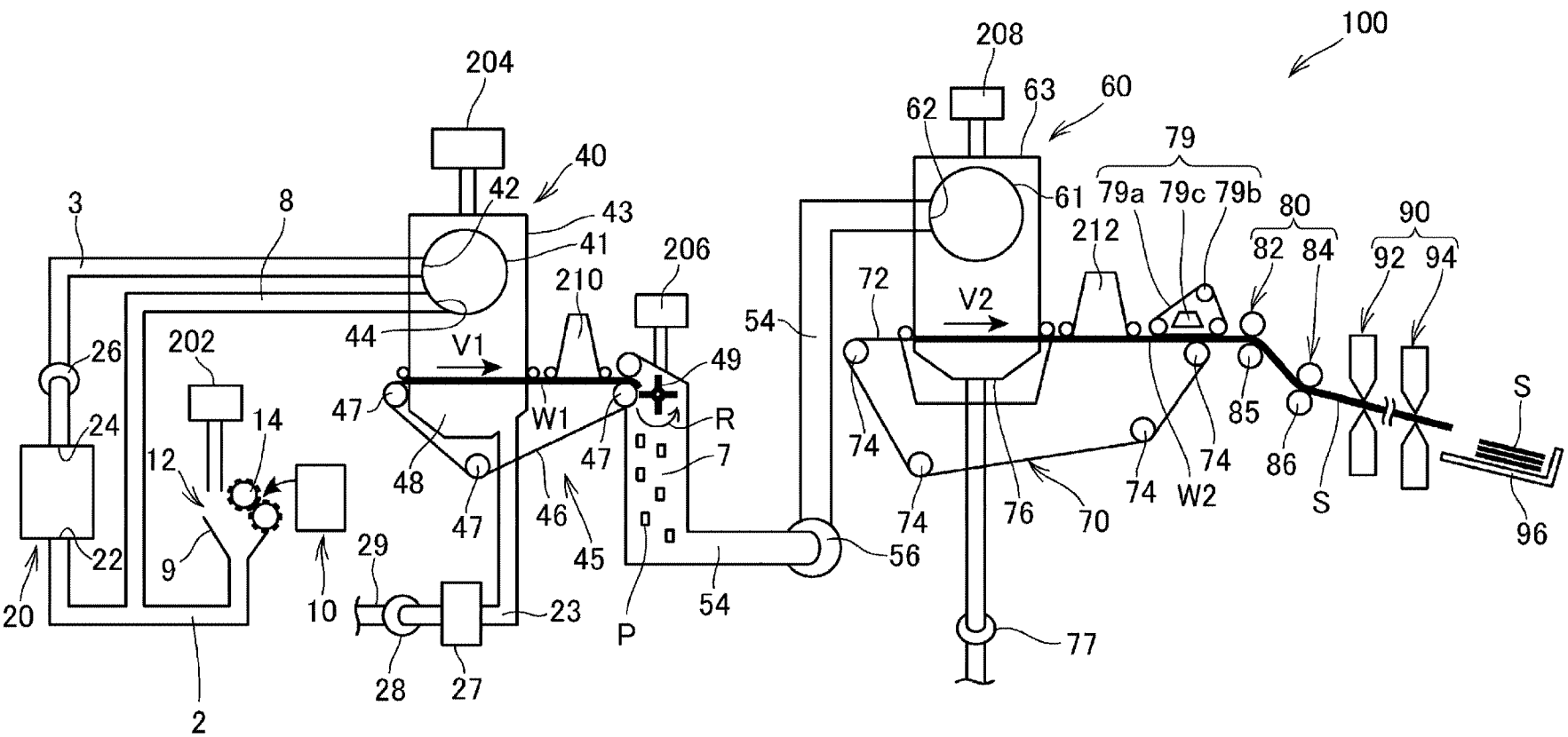
FIG. 1 is a schematic view showing a fiber body forming apparatus according to this embodiment.

First, a fiber body forming apparatus according to this embodiment will be described with reference to the drawing. FIG. 1 is a schematic view showing a fiber body forming apparatus 100 according to this embodiment.

The fiber body forming apparatus 100 is, for example, a preferable apparatus which manufactures new paper by defibrating used waste paper as a raw material into fibers by a dry method, followed by pressure application, heating, and cutting. By the fiber body forming apparatus 100, since paper is formed while the density, the thickness, and the shape thereof are controlled, in accordance with the application, such as office paper having an A4 or an A3 size or paper for name cards, paper having various thicknesses and sizes can be manufactured.

The fiber body forming apparatus 100 includes, for example, a supply portion 10, a coarsely pulverizing portion 12, a defibrating portion 20, a sorting portion 40, a first web forming portion 45, a rotation body 49, a deposition portion 60, a second web forming portion 70, a transport portion 79, a sheet forming portion 80, and a cutting portion 90.

In order to humidify the raw material, a space in which the raw material is transferred, and the like, the fiber body forming apparatus 100 further includes humidifying portions 202, 204, 206, 208, 210, and 212.

The humidifying portions 202, 204, 206, and 208 are each formed, for example, of a vaporization type or a hot-wind vaporization type humidifier. That is, the humidifying portions 202, 204, 206, and 208 each have a filter (not shown) to be infiltrated with water and each supply humidified air having an increased humidity by allowing air to pass through the filter. The humidifying portions 202, 204, 206, and 208 each may also include a heater (not shown) which effectively increases the humidity of the humidified air.

The humidifying portions 210 and 212 are each formed, for example, of an ultrasonic type humidifier. That is, the humidifying portions 210 and 212 each include a vibration portion (not shown) which atomizes water and each supply mist generated by the vibration portion.

The supply portion 10 supplies the raw material to the coarsely pulverizing portion 12. The raw material to be supplied to the coarsely pulverizing portion 12 may be any material as long as containing fibers, and for example, there may be mentioned paper, pulp, a pulp sheet, a non-woven cloth, a cloth, or a woven fabric. In this embodiment, the structure of the fiber body forming apparatus 100 in which waste paper is used as the raw material will be described by way of example. The supply portion 10 includes, for example, a stacker in which waste paper is stacked and stored and an automatic charge device feeding the waste paper from the stacker to the coarsely pulverizing portion 12. In addition, a plurality of the waste paper is not always required to be aligned and stacked to each other, and waste paper having various sizes and waste paper having various shapes may be irregularly supplied to the stacker.

The coarsely pulverizing portion 12 cuts the raw material supplied by the supply portion 10 using coarsely pulverizing blades 14 into coarsely pulverized pieces. The coarsely pulverizing blade 14 cuts the raw material in a gas such as the air. The coarsely pulverizing portion 12 includes, for example, a pair of the coarsely pulverizing blades 14 which sandwich and cut the raw material and a drive portion which rotates the coarsely pulverizing blades 14 and can be formed to have a structure similar to that of a so-called shredder. The shape and the size of the coarsely pulverized pieces are arbitrary and may be appropriately determined so as to be suitable to a defibrating treatment in the defibrating portion 20. The coarsely pulverizing portion 12 cuts the raw material into pieces having a size of, for example, one centimeter square to several centimeters square or pieces smaller than that described above.

The coarsely pulverizing portion 12 includes a shoot 9 receiving the coarsely pulverized pieces which fall down after being cut by the coarsely pulverizing blades 14. The shoot 9 has, for example, a tapered shape in which the width thereof is gradually decreased in a direction along which the coarsely pulverized pieces flow down. Hence, the shoot 9 is able to receive many coarsely pulverized pieces. A tube 2 which communicates with the defibrating portion 20 is coupled to the shoot 9 to form a transport path through which the coarsely pulverized pieces are transported to the defibrating portion 20. The coarsely pulverized pieces are collected by the shoot 9 and are transported to the defibrating portion 20 through the tube 2. The coarsely pulverized pieces are transported by an air stream generated by, for example, a blower (not shown) toward the defibrating portion 20 through the tube 2.

To the shoot 9 of the coarsely pulverizing portion 12 or the vicinity of the shoot 9, humidified air is supplied by the humidifying portion 202. Accordingly, the coarsely pulverized pieces cut by the coarsely pulverizing blades 14 are suppressed from being adhered to inner surfaces of the shoot 9 and the tube 2 caused by static electricity. In addition, since the coarsely pulverized pieces cut by the coarsely pulverizing blades 14 are transported to the defibrating portion 20 together with humidified air having a high humidity, an effect of suppressing the adhesion of a defibrated material in the defibrating portion 20 can also be anticipated. In addition, the humidifying portion 202 may also be configured so as to supply humidified air to the coarsely pulverizing blades 14 and to remove electricity of the raw material supplied by the supply portion 10. In addition, besides the humidifying portion 202, removal of electricity may also be performed using an ionizer.

The defibrating portion 20 defibrates the coarsely pulverized pieces cut in the coarsely pulverizing portion 12. In more particular, in the defibrating portion 20, the raw material cut by the coarsely pulverizing portion 12 is processed by the defibrating treatment to produce a defibrated material. In this case, the "defibrate" indicates that the raw material formed of fibers bound to each other is disentangled into separately independent fibers. The defibrating portion 20 also has a function to separate substances, such as resin particles, an ink, a toner, and a blurring inhibitor, each of which is adhered to the raw material, from the fibers.

A material passing through the defibrating portion 20 is called a "defibrated material". In the "defibrated material", besides the fibers thus disentangled, resin particles, that is, resin particles functioning to bind fibers together; coloring materials, such as an ink and a toner; and additives, such as a blurring inhibitor and a paper strength improver, which are separated from the fibers when the fibers are disentangled, may also be contained in some cases. The defibrated material thus disentangled has a string shape or a ribbon shape. The defibrated material thus disentangled may be present in a state, that is, in an independent state, so as not to be entangled with other disentangled fibers or may be present in a state, that is, in a state in which so-called "damas" are formed, so as to be entangled together to form lumps.

The defibrating portion 20 performs dry defibration. In this case, a treatment, such as defibration, which is performed not in a liquid but in a gas, such as the air, is called a dry type. The defibrating portion 20 is formed, for example, to use an impellor mill. In particular, although not shown in the drawing, the defibrating portion 20 includes a high-speed rotating rotor and a liner disposed around the outer circumference of the rotor. The coarsely pulverized pieces cut by the coarsely pulverizing portion 12 are sandwiched between the rotor and the liner of the defibrating portion 20 and are then defibrated thereby. The defibrating portion 20 generates an air stream by the rotation of the rotor. By this air stream, the defibrating portion 20 sucks the coarsely pulverized pieces functioning as the raw material through the tube 2, and the defibrated material can be transported to a discharge port 24. The defibrated material is fed to a tube 3 from the discharge port 24 and then transported to the sorting portion 40 through the tube 3.

As described above, the defibrated material produced in the defibrating portion 20 is transported to the sorting portion 40 from the defibrating portion 20 by the air stream generated thereby. Furthermore, in the example shown in the drawing, the fiber body forming apparatus 100 includes a defibrating blower 26 functioning as an air stream generator, and by an air stream generated by the defibrating blower 26, the defibrated material is transported to the sorting portion 40. The defibrating blower 26 is provided for the tube 3, and air is sucked together with the defibrated material from the defibrating portion 20 and then sent to the sorting portion 40.

The sorting portion 40 includes an inlet port 42 into which the defibrated material defibrated in the defibrating portion 20 flows together with the air stream through the tube 3. The sorting portion 40 sorts the defibrated material introduced into the inlet port 42 by the length of the fibers. In particular, the sorting portion 40 sorts the defibrated material defibrated in the defibrating portion 20 into a defibrated material having a predetermined size or less as a first sorted material and a defibrated material larger than the first sorted material as a second sorted material. The first sorted material includes fibers, particles, and the like, and the second sorted material includes, for example, large fibers, non-defibrated pieces, coarsely pulverizing pieces which are not sufficiently defibrated, and damas which are formed since defibrated fibers are aggregated or entangled with each other.

The sorting portion 40 includes, for example, a drum portion 41 and a housing portion 43 receiving the drum portion 41.

The drum portion 41 is a cylindrical sieve which is rotatably driven by a motor. The drum portion 41 has a net and functions as a sieve. By the meshes of this net, the drum 41 sorts the first sorted material smaller than the sieve opening of the net and the second sorted material larger than the sieve opening of the net. As the net of the drum portion 41, for example, there may be used a metal net, an expanded metal formed by expanding a metal plate provided with cut lines, or a punched metal in which holes are formed in a metal plate by a press machine or the like.

The defibrated material introduced into the inlet port 42 is fed together with the air stream to the inside of the drum portion 41, and by the rotation of the drum portion 41, the first sorted material is allowed to fall down through the meshes of the net of the drum portion 41. The second sorted material which is not allowed to pass through the meshes of the net of the drum portion 41 is guided to a discharge port 44 by the air stream flowing into the drum portion 41 from the inlet port 42 and is then fed to a tube 8.

The tube 8 communicates between the inside of the drum portion 41 and the tube 2. The second sorted material which flows through the tube 8 flows together with the coarsely pulverized pieces cut by the coarsely pulverizing portion 12 in the tube 2 and is then guided to an inlet port 22 of the defibrating portion 20. Accordingly, the second sorted material is returned to the defibrating portion 20 and is then subjected to the defibrating treatment.

In addition, the first sorted material sorted by the drum portion 41 is dispersed in air through the meshes of the net of the drum portion 41 and is then allowed to fall down to a mesh belt 46 of the first web forming portion 45 located under the drum portion 41.

The first web forming portion 45 includes the mesh belt 46, rollers 47, and a suction portion 48. The mesh belt 46 is an endless belt, is suspended by the three rollers 47, and by the movement of the rollers 47, is transported in a direction shown by an arrow in the drawing. The surface of the mesh belt 46 is formed of a net in which openings having a predetermined size are arranged. Of the first sorted material which is allowed to fall down from the sorting portion 40, fine particles passing through the meshes of the net fall down to a lower side of the mesh belt 46, and fibers having a size which are not allowed to pass through the meshes of the net are deposited on the mesh belt 46 and are transported therewith in the arrow direction. The fine particles which fall down through the mesh belt 46 include particles having a relatively small size and/or a low density of the defibrated material, that is, include resin particles, coloring materials, additives, and the like, which are not necessary for binding between the fibers, and the fine particles are unnecessary materials which will not be used for manufacturing of a sheet S by the fiber body forming apparatus 100.

The mesh belt 46 is transferred at a predetermined velocity V1 during a normal operation for manufacturing of the sheet S. In the case described above, "during the normal operation" indicates during the operation other than that performing a start control and a stop control of the fiber body forming apparatus 100 and, in more particular, indicates during manufacturing of a sheet S having a preferable quality by the fiber body forming apparatus 100.

Accordingly, the defibrated material processed by the defibrating treatment in the defibrating portion 20 is sorted into the first sorted material and the second sorted material in the sorting portion 40, and the second sorted material is returned to the defibrating portion 20. In addition, from the first sorted material, the unnecessary materials are removed by the first web forming portion 45. The residues obtained after the unnecessary materials are removed from the first sorted material are a material suitable for manufacturing of the sheet S, and this material is deposited on the mesh belt 46 to form a first web W1.

The suction portion 48 sucks air under the mesh belt 46. The suction portion 48 is coupled to a dust collection portion 27 through a tube 23. The dust collection portion 27 is a filter-type or a cyclone-type dust collection device and separates fine particles from the air stream. A collection blower 28 is provided at a downstream side of the dust collection portion 27 and functions as a dust suction portion which sucks air from the dust collection portion 27. In addition, air discharged from the collection blower 28 is discharged outside of the fiber body forming apparatus 100 through a tube 29.

According to the fiber body forming apparatus 100, by the collection blower 28, air is sucked from the suction portion 48 through the dust collection portion 27. In the suction portion 48, fine particles passing through the meshes of the net of the mesh belt 46 are sucked together with air and are then fed to the dust collection portion 27 through the tube 23. In the dust collection portion 27, the fine particles passing through the mesh belt 46 are separated from the air stream and are then accumulated.

Hence, fibers obtained after the unnecessary materials are removed from the first sorted material are deposited on the mesh belt 46, and hence, the first web W1 is formed. Since the suction is performed by the collection blower 28, the formation of the first web W1 on the mesh belt 46 is promoted, and in addition, the unnecessary materials can be rapidly removed.

To a space including the drum portion 41, humidified air is supplied by the humidifying portion 204. By this humidified air, the first sorted material is humidified in the sorting portion 40. Accordingly, the adhesion of the first sorted material to the mesh belt 46 caused by static electricity is suppressed, so that the first sorted material is likely to be peeled away from the mesh belt 46. Furthermore, the adhesion of the first sorted material to the rotation body 49 and the inner wall of the housing portion 43 caused by static electricity can be suppressed. In addition, by the suction portion 48, the unnecessary materials can be efficiently sucked.

In addition, in the fiber body forming apparatus 100, the structure in which the first sorted material and the second sorted material are sorted and separated is not limited to the sorting portion 40 including the drum portion 41. For example, the structure in which the defibrated material obtained by the defibrating treatment in the defibrating portion 20 is classified by a classifier may also be used. As the classifier, for example, a cyclone classifier, an elbow-jet classifier, or an eddy classifier may be used. When those classifiers are used, the first sorted material and the second sorted material can be sorted and separated. Furthermore, by the classifiers described above, the structure in which materials having a relatively small size and/or a low density, that is, the unnecessary materials, such as resin particles, coloring materials, and additives, which are not necessary for binding between the fibers, in the defibrated material are separated and removed therefrom can be realized. For example, the structure in which fine particles contained in the first sorted material are removed therefrom by a classifier may also be formed. In this case, the structure in which the second sorted material is returned, for example, to the defibrating portion 20, the unnecessary materials are collected by the dust collection portion 27, and the first sorted material other than the unnecessary materials is fed to a tube 54 may be formed.

In a transport path of the mesh belt 46, at a downstream side of the sorting portion 40, air containing mist is supplied by the humidifying portion 210. The mist which is fine particles of water generated by the humidifying portion 210 falls down to the first web W1 and supplies moisture thereto. Accordingly, the moisture amount contained in the first web W1 is adjusted, and hence, for example, the adsorption of the fibers to the mesh belt 46 caused by static electricity can be suppressed.

The fiber body forming apparatus 100 includes the rotation body 49 which divides the first web W1 deposited on the mesh belt 46. The first web W1 is peeled away from the mesh belt 46 at a position at which the mesh belt 46 is folded by the roller 47 and is then divided by the rotation body 49.

The first web W1 is a soft material having a web shape formed by deposition of the fibers, and the rotation body 49 disentangles the fibers of the first web W1.

Although the structure of the rotation body 49 is arbitrarily formed, in the example shown in the drawing, the rotation body 49 has a rotating blade shape having rotatable plate-shaped blades. The rotation body 49 is disposed at a position at which the first web W1 peeled away from the mesh belt 46 is brought into contact with the blade. By the rotation of the rotation body 49, such as the rotation in a direction indicated by an arrow R in the drawing, the first web W1 peeled away from and transported by the mesh belt 46 collides with the blade and is divided thereby, so that small parts P are produced.

In addition, the rotation body 49 is preferably placed at a position at which the blade of the rotation body 49 does not collide with the mesh belt 46. For example, the distance between a front end of the blade of the rotation body 49 and the mesh belt 46 can be set to be 0.05 to 0.5 mm, and in this case, without causing damage on the mesh belt 46, the first web W1 can be efficiently divided by the rotation body 49.

The small parts P divided by the rotation body 49 fall down in a tube 7 and are then transported to the tube 54 by an air stream flowing inside the tube 7.

In addition, to a space including the rotation body 49, humidified air is supplied by the humidifying portion 206. Accordingly, a phenomenon in which the fibers are adsorbed by static electricity to the inside of the tube 7 and the blades of the rotation body 49 can be suppressed.

By the air stream generated by the blower 56, the small parts P falling down in the tube 7 are sucked in the tube 54 and are allowed to pass through the inside of the blower 56. By the air stream generated by the blower 56 and the function of a rotating portion, such as a blade, of the blower 56, the small parts P are transported to the deposition portion 60 through the tube 54.

The deposition portion 60 deposits the defibrated material defibrated in the defibrating portion 20. In more particular, the deposition portion 60 introduces the small parts P through an inlet port 62 and disentangles the defibrated material thus entangled, so that the defibrated material is allowed to fall down while being dispersed in air. Accordingly, the deposition portion 60 can uniformly deposit the defibrated material in the second web forming portion 70.

The deposition portion 60 includes a drum portion 61 and a housing portion 63 receiving the drum portion 61. The drum portion 61 is a cylindrical sieve rotatably driven by a motor. The drum portion 61 has a net and functions as a sieve. By the meshes of this net, the drum portion 61 allows fibers and particles, each of which is smaller than the mesh opening of this net, to pass through and fall down from the drum portion 61. For example, the structure of the drum portion 61 is the same as that of the drum portion 41.

In addition, the "sieve" of the drum portion 61 may not have a function to sort a specific object. That is, the "sieve" to be used as the drum portion 61 indicates a member provided with a net, and the drum portion 61 may allow all of the defibrated material introduced thereinto to fall down.

Under the drum portion 61, the second web forming portion 70 is disposed. The second web forming portion 70 deposits a material passing through the deposition portion 60 to form a second web W2. The second web forming portion 70 includes, for example, a mesh belt 72, rollers 74, and a suction mechanism 76.

The mesh belt 72 is an endless belt, is suspended by the rollers 74, and by the movement of the rollers 74, is transported in a direction shown by an arrow in the drawing. The mesh belt 72 is formed, for example, of a metal, a resin, a cloth, or a non-woven cloth. The surface of the mesh belt 72 is formed of a net in which openings having a predetermined size are arranged. Of the fibers which are allowed to fall down from the drum portion 61, fibers having a size which are allowed to pass through the meshes of the net fall down to a lower side of the mesh belt 72, and fibers having a size which are not allowed to fall down through the meshes of the net are deposited on the mesh belt 72 and are transported therewith in the arrow direction. The mesh belt 72 is transferred at a predetermined velocity V2 during a normal operation for manufacturing of the sheet S. The "during the normal operation" indicates the same as described above.

The meshes of the net of the mesh belt 72 are fine and may be set so that most of the fibers falling down from the drum portion 61 are not allowed to pass therethrough.

The suction mechanism 76 is provided at a lower side of the mesh belt 72. The suction mechanism 76 includes a suction blower 77, and by a suction force of the suction blower 77, an air stream toward a lower side can be generated in the suction mechanism 76.

By the suction mechanism 76, a defibrated material dispersed in air by the deposition portion 60 is sucked on the mesh belt 72. Accordingly, the formation of the second web W2 on the mesh belt 72 is promoted, and hence, a discharge rate from the deposition portion 60 can be increased. Furthermore, by the suction mechanism 76, a downflow can be formed in a falling path of the defibrated material, and hence, the defibrated material can be prevented from being entangled with each other during the falling.

The suction blower 77 may discharge air sucked from the suction mechanism 76 outside of the fiber body forming apparatus 100 through a collection filter (not shown). Alternatively, air sucked by the suction blower 77 may be fed to the dust collection portion 27 so that unnecessary materials contained in the air sucked by the suction mechanism 76 may be collected.

To a space including the drum portion 61, humidified air is supplied by the humidifying portion 208. By this humidified air, the inside of the deposition portion 60 can be humidified, and the adhesion of fibers to the housing portion 63 caused by static electricity is suppressed, so that the fibers are allowed to rapidly fall down on the mesh belt 72, and the second web W2 can be formed to have a preferable shape.

As described above, through the deposition portion 60 and the second web forming portion 70, the second web W2 can be formed so as to be softly expanded with a large amount of air incorporated therein. The second web W2 deposited on the mesh belt 72 is transported to the sheet forming portion 80.

In a transport path of the mesh belt 72, at a downstream side of the deposition portion 60, by the humidifying portion 212, air containing mist is supplied. Accordingly, the mist generated by the humidifying portion 212 is supplied to the second web W2, so that the content of moisture contained in the second web W2 is adjusted. Accordingly, for example, the adsorption of fibers to the mesh belt 72 caused by static electricity can be suppressed.

The fiber body forming apparatus 100 includes the transport portion 79 which transports the second web W2 on the mesh belt 72 to the sheet forming portion 80. The transport portion 79 includes, for example, a mesh belt 79*a*, rollers 79*b*, and a suction mechanism 79*c*.

The suction mechanism 79*c* includes a blower not shown, and by a suction force of the blower, an upward air stream is generated to the mesh belt 79*a*. This air stream sucks the second web W2, and the second web W2 is separated from the mesh belt 72 and then adsorbed to the mesh belt 79*a*. The mesh belt 79*a* is transferred by the rotations of the rollers 79*b*, so that the second web W2 is transported to the sheet forming portion 80. The transfer rate of the mesh belt 72 is the same, for example, as the transfer rate of the mesh belt 79*a*.

As described above, the transport portion 79 peels away the second web W2 formed on the mesh belt 72 therefrom and then transports the second web W2 thus peeled away.

The sheet forming portion 80 forms the sheet S from a deposit deposited in the deposition portion 60. In more particular, the sheet forming portion 80 forms the sheet S by heating and pressurizing the second web W2 which is deposited on the mesh belt 72 and is then transported by the transport portion 79.

The sheet forming portion 80 includes a pressure application portion 82 which pressurizes the second web W2 and a heating portion 84 which heats the second web W2 pressurized by the pressure application portion 82.

The pressure application portion 82 is formed of a pair of calendar rollers 85 which sandwich the second web W2 at a predetermined nip pressure for pressure application. Since the second web W2 is pressurized, the thickness thereof is decreased, and hence, the density of the second web W2 is increased. One of the pair of calendar rollers 85 is a drive roller driven by a motor not shown in the drawing, and the other roller is a driven roller. The calendar rollers 85 are rotated by a driving force of the motor, and the second web W2, the density of which is increased by the pressure application, is transported toward the heating portion 84.

The heating portion 84 is formed, for example, using heating rollers, a heat press forming machine, a hot plate, a hot-wind blower, an infrared heater, or a flash fixing device. In the example shown in the drawing, the heating portion 84 includes a pair of heating rollers 86. The heating rollers 86 are heated to a predetermined temperature by a heater disposed inside or outside. The heating rollers 86 sandwich the second web W2 pressurized by the calendar rollers 85 for heating, so that the sheet S is formed.

One of the pair of heating rollers 86 is a drive roller driven by a motor not shown in the drawing, and the other roller is a driven roller. The heating rollers 86 are rotated by a driving force of the motor, so that the sheet S thus heated is transported toward the cutting portion 90.

As described above, the second web W2 formed in the deposition portion 60 is pressurized and heated in the sheet forming portion 80, so that the sheet S is formed.

In addition, the number of the calendar rollers 85 of the pressure application portion 82 and the number of the heating rollers 86 of the heating portion 84 are not particularly limited.

The cutting portion 90 cuts the sheet S formed in the sheet forming portion 80. In the example shown in the drawing, the cutting portion 90 includes a first cutting portion 92 which cuts the sheet S in a direction intersecting a transport direction of the sheet S and a second cutting portion 94 which cuts the sheet S in a direction parallel to the transport direction. The second cutting portion 94 cuts, for example, the sheet S which passes through the first cutting portion 92.

As described above, a single sheet S having a predetermined size is formed. The single sheet S thus cut is discharged to a discharge portion 96. The discharge portion 96 includes a tray or a stacker on each of which sheets S each having a predetermined size are placed.

In addition, although not shown in the drawing, the humidifying portions 202, 204, 206, and 208 may be formed from one vaporization type humidifier. In this case, the structure may be formed so that humidified air generated by one humidifier is branched and supplied to the coarsely pulverizing portion 12, the housing portion 43, the tube 7, and the housing portion 63. When a duct which supplies humidified air is branched and then installed, the structure described above can be easily realized. In addition, the humidifying portions 202, 204, 206, and 208 may also be formed from two or three vaporization type humidifiers.

In addition, the humidifying portions 210 and 212 may be formed from one ultrasonic type humidifier or may be formed from two ultrasonic type humidifiers. For example, air containing mist generated by one humidifier may be configured to be branched and supplied to the humidifying portions 210 and 212.

1.2. Liquid Application Device

Figure 2:
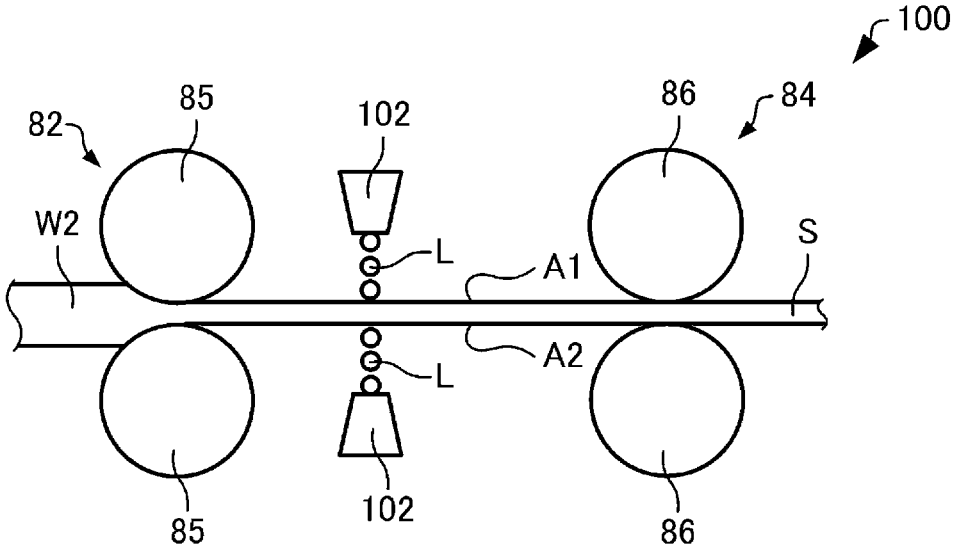
FIG. 2 is a schematic view showing liquid application devices of the fiber body forming apparatus according to this embodiment.

Next, a liquid application device of the fiber body forming apparatus 100 will be described with reference to the drawing. FIG. 2 is a schematic view showing liquid application devices 102 of the fiber body forming apparatus 100. As shown in FIG. 2, the fiber body forming apparatus 100 includes the liquid application devices 102.

In addition, for the convenience of illustration, the liquid application devices 102 are omitted in FIG. 1. In addition, in FIG. 1, although an example in which the second web W2 is transported in an inclined lower direction from the pressure application portion 82 is shown, in FIG. 2, an example in which the second web W2 is transported in a horizontal direction from the pressure application portion 82 is shown.

As shown in FIG. 2, the liquid application devices 102 apply a liquid L to the second web W2 containing fibers. Hereinafter, the "second web W2" is also simply called "web W2" in some cases.

The liquid application device 102 is an ink jet head and applies the liquid L by an ink jet method. The liquid application device 102 may be a line head type ink jet head having a width larger than the width of the web W2. Accordingly, the productivity can be improved. In addition, the liquid application device 102 may be not a line head type and may be a type in which the head itself moves.

For example, the two liquid application devices 102 are provided. In the example shown in the drawing, between the two liquid application devices 102, the web W2 is located. One of the two liquid application devices 102 applies the liquid L to one surface A1 of the web W2, and the other liquid application device 102 applies the liquid L to the other surface A2 of the web W2.

In the example shown in the drawing, the two liquid application devices 102 are provided so as to be overlapped with each other in a thickness direction of the web W2. The two liquid application devices 102 may simultaneously apply the liquid L to the web W2.

The liquid application devices 102 apply the liquid L to the web pressurized by the pressure application portion 82. Since the web W2 is pressurized by the pressure application portion 82, the bulk density of the web W2 is increased to 0.09 g/cm$^3$ or more. That is, the web W2 is pressurized by the pressure application portion 82 to have a bulk density of 0.09 g/cm$^3$ or more, and the liquid application devices 102 apply the liquid L to the web W2 having a bulk density of 0.09 g/cm$^3$ or more. The liquid application devices 102 apply the liquid L to the web W2, the bulk density of which is preferably 0.09 to 0.80 g/cm$^3$, and more preferably 0.20 to 0.70 g/cm$^3$. In addition, the "bulk density" indicates a loose bulk density.

The pressure to be applied to the web W2 by the pressure application portion 82 is, for example, 1 to 600 kgf/cm$^2$, preferably 1 to 500 kgf/cm$^2$, and more preferably 3 to 300 kgf/cm$^2$.

The heating portion 84 heats the web W2 to which the liquid L is applied by the liquid application devices 102. The web W2 heated by the heating portion 84 is formed into the sheet S. The liquid application devices 102 are provided, for example, between the calendar rollers 85 of the pressure application portion 82 and the heating rollers 86 of the heating portion 84. The temperature of the heating portion 84 is, for example, 70° C. to 220° C. and preferably 100° C. to 180° C.

The liquid L contains a binder which binds fibers of the web W2. In the web W2 before the liquid L is applied thereto, for example, the binder is not contained. The binder contained in the liquid L is, for example, a thermoplastic resin or a thermosetting resin. As the thermoplastic resin, for example, there may be mentioned a styrene-butadiene copolymer, an acrylonitrile-butadiene copolymer, an acrylic acid ester copolymer, a styrene-acrylic acid copolymer, a polyurethane, a polyester, a poly(vinyl acetate), an ethylene-vinyl acetate copolymer, a polyacrylamide, a poly(vinyl alcohol), or a poly(vinyl pyrrolidone). As the thermosetting resin, for example, there may be mentioned an epoxy resin, a phenol resin, an urea resin, a melamine resin, an unsaturated polyester resin, an alkyd resin, a diallyl phthalate resin, a vinyl ester resin, or a thermosetting polyimide. The liquid L may contain at least one of those resins mentioned above. In addition, in consideration of easy ejection of the liquid L from the liquid application device 102, the liquid L is preferably an emulsion.

The glass transition temperature of each of the thermoplastic resin and the thermosetting resin contained in the liquid L is, for example, −50° C. to 130° C. and preferably −30° C. to 100° C. When the glass transition temperature of the binder is in the range described above, binding between the fibers can be improved, and a paper strength can be increased.

The content of the binder in the liquid L is, for example, 0.1 to 30.0 percent by mass and preferably 0.1 to 20.0 percent by mass. When the content described above is 0.1 to 30.0 percent by mass, the viscosity of the liquid L can be decreased so that the liquid L can be sufficiently ejected from the liquid application device 102.

When being heated by the heating portion 84, the fibers contained in the web W2 are bound together by the binder contained in the liquid L. In addition, although not shown in the drawing, besides the heating portion 84, for example, by hot wind, infrared rays, electromagnetic waves, heating rollers, or a heat press, the web W2 to which the liquid L is applied may be separately heated. Accordingly, melt binding and/or gluing of the binder contained in the liquid L can be promoted, and in addition, drying of water or the like can also be promoted.

The viscosity of the liquid L is preferably 8.0 mPa·s or less at 20° C. When the viscosity of the liquid L is more than 8.0 mPa·s, the viscosity is excessively high, and hence, it may become difficult to eject the liquid L from the liquid application device 102 in some cases.

The liquid L may contain a penetrant. Accordingly, the infiltration of the liquid L in the thickness direction of the web W2 is improved. Hence, fiber binding in the sheet S can be improved, interlayer peeling of the sheet S can be suppressed, and the tensile strength thereof can be increased. As the penetrant contained in the liquid L, for example, there may be mentioned a glycol ether, such as triethylene glycol monobutyl ether, triethylene glycol dimethyl ether, triethylene glycol diethyl ether, triethylene glycol dibutyl ether, or triethylene glycol methyl butyl ether; a silicone-based surfactant, an acetylene glycol-based surfactant, an acetylene alcohol-based surfactant, or a fluorine-based surfactant. The liquid L may contain at least one of the penetrants mentioned above.

The content of the penetrant in the liquid L is, for example, 0.1 to 30.0 percent by mass and preferably 0.1 to 20.0 percent by mass. When the content described above is 0.1 to 30.0 percent by mass, the infiltration of the liquid L in the web W2 is promoted, and hence, the paper strength of the sheet S can be increased.

The liquid L may contain a moisturizer. Accordingly, when the liquid L is ejected, clogging of a nozzle hole of the liquid application device 102 is not likely to occur. As the moisturizer contained in the liquid L, for example, there may be mentioned diethylene glycol, triethylene glycol, propylene glycol, dipropylene glycol, 1,3-propanediol, 1,3-butylene glycol, 1,4-butanediol, 1,5-pentanediol, 1,6-hexanediol, 2-ethyl-2-methyl-1,3-propanediol, 2-methyl-2-propyl-1,3-propanediol, 2-methyl-1,3-propanediol, 2,2-dimethyl-1,3-propanediol, 3-methyl-1,3-propanediol, 1,2-hexanediol, 2-ethyl-1,3-hexanediol, 3-methyl-1,5-penetandiol, 2-methylpenetane-2,4-diol, trimethylolpropane, or glycerin. The liquid L may contain at least one of the moisturizers mentioned above.

The content of the moisturizer in the liquid L is, for example, 1.0 to 30.0 percent by mass, preferably 3.0 to 20.0 percent by mass, and more preferably 5.0 to 16.0 percent by mass. When the content described above is 1.0 to 30.0 percent by mass, the clogging of the nozzle hole of the liquid application device 102 can be sufficiently suppressed.

The liquid L may contain water. As the water, purified water or ultra purified water, such as ion-exchanged water, ultrafiltrated water, reverse osmosis water, or distilled water, may be mentioned. In addition, water sterilized by UV irradiation or addition of hydrogen peroxide is preferable since the generation of fungi and/or bacterial can be prevented, and long storage can be performed. For example, when sheets S having the same bulk density are obtained, if the liquid L contains water, compared to the case in which water is not contained, the pressure of the pressure application portion 82 can be decreased.

As other additives to be contained in the liquid L, for example, there may be mentioned an UV absorber, a light stabilizer, a quencher, an antioxidant, a water resistant agent, a fungicide, an antiseptic agent, a thickening agent, a flow modifier, a pH adjuster, a defoaming agent, an antifoam agent, a leveling agent, and/or a antistatic agent.

1.3. Features

The fiber body forming apparatus 100 has, for example, the following features.

The fiber body forming apparatus 100 includes the two liquid application devices 102 which apply the liquid L to the web W2 containing fibers and having a bulk density of 0.09 g/cm$^3$ or more, the liquid L containing the binder which binds the fibers together. Hence, in the fiber body forming apparatus 100, compared to the case in which the liquid is applied to a web having a bulk density of less than 0.09 g/cm$^3$, the liquid L can be infiltrated deeply in the web W2. Accordingly, the interlayer peeling can be made unlikely to occur in the sheet S.

The fiber body forming apparatus 100 includes the pressure application portion 82 which pressurizes the web W2 containing fibers and the liquid application devices 102 which apply the liquid L to the web W2 pressurized by the pressure application portion 82, the liquid L containing the binder which binds the fibers together. Hence, in the fiber body forming apparatus 100, compared to the case in which the liquid is applied to the web which is not pressurized, the liquid L can be infiltrated deeply in the web W2. Accordingly, the interlayer peeling can be made unlikely to occur in the sheet S.

Figure 3:
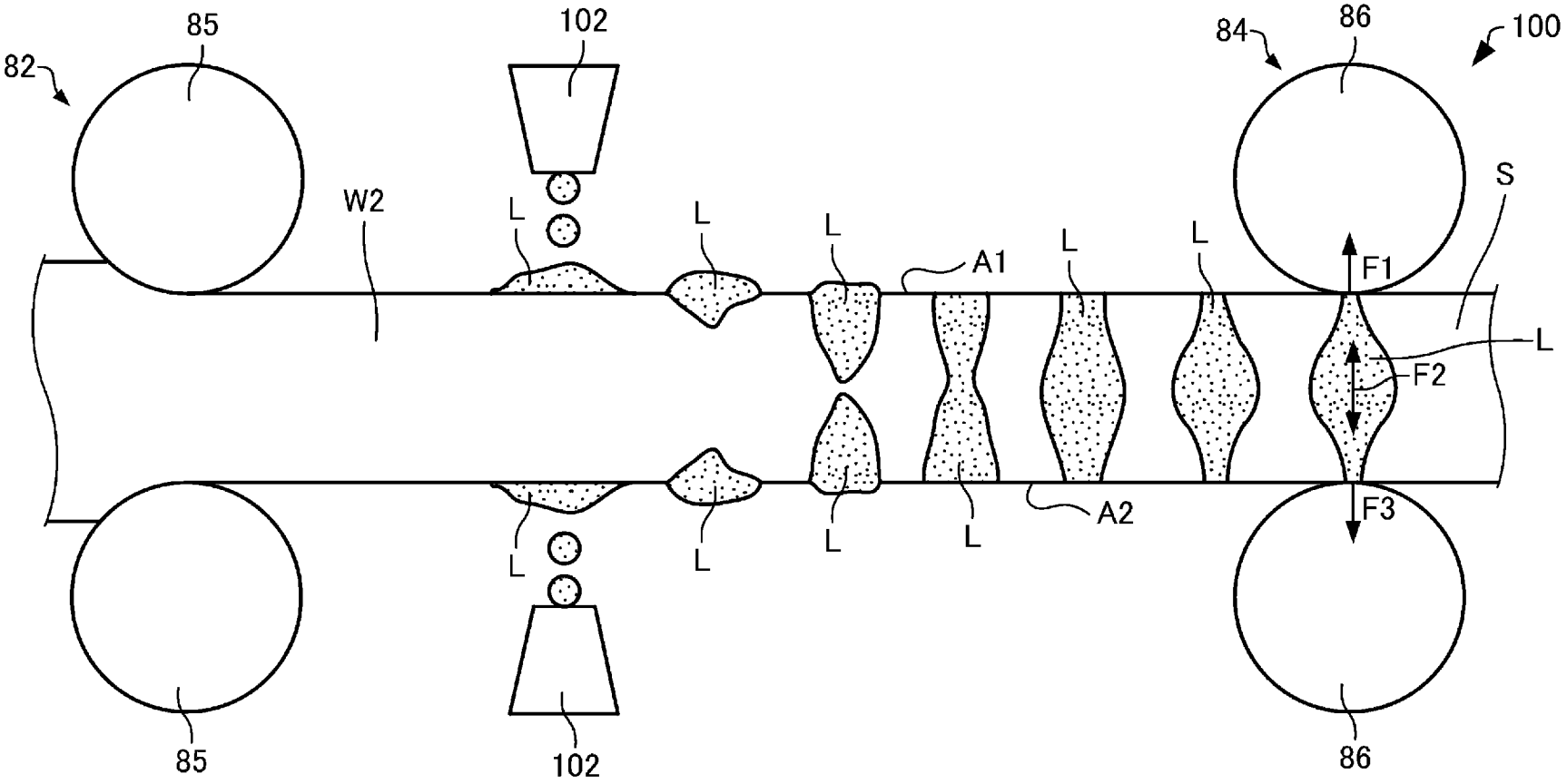
FIG. 3 is a view illustrating infiltration of a liquid in a web in the fiber body forming apparatus according to this embodiment.
Figure 4:
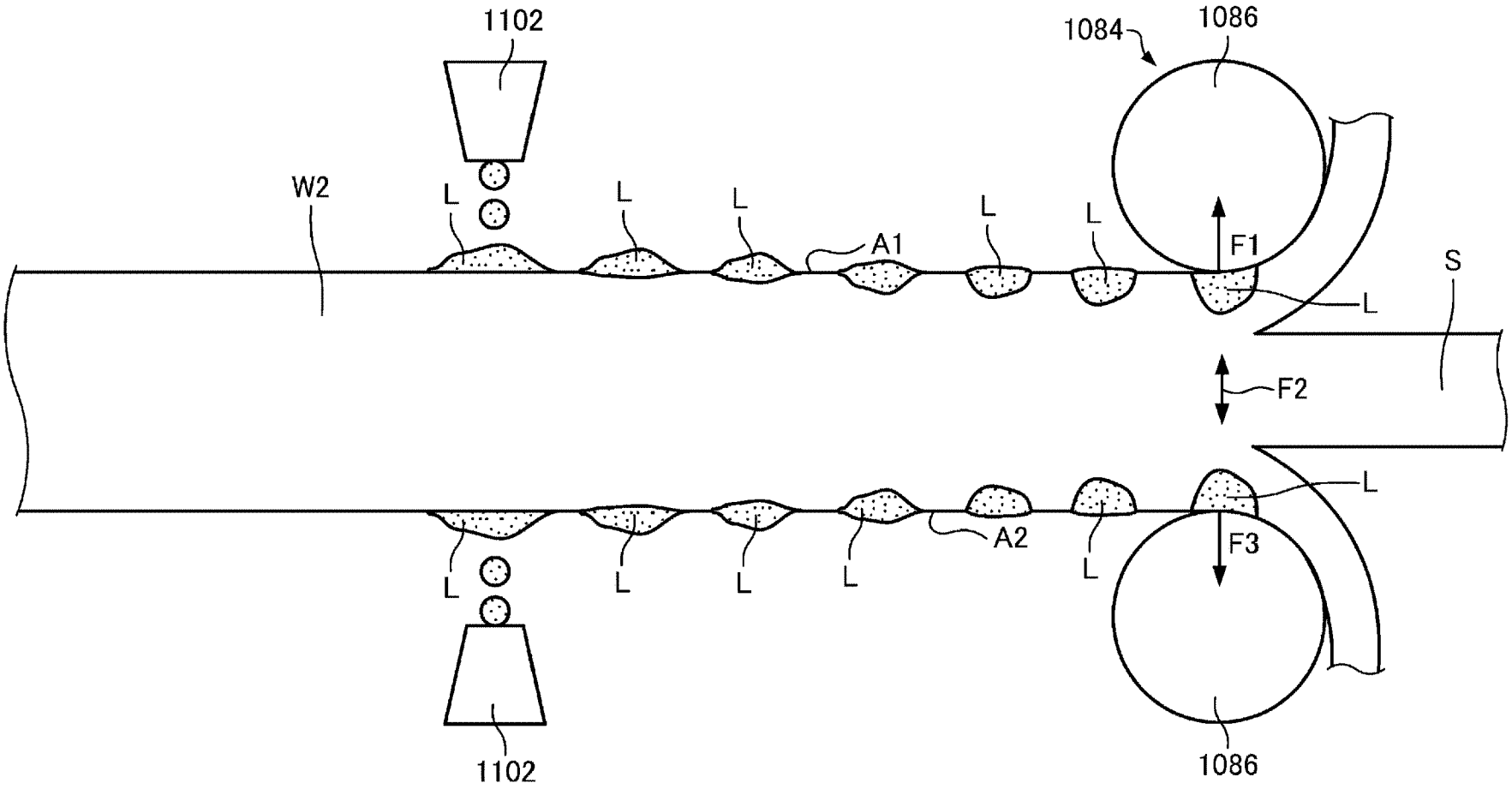
FIG. 4 is a view illustrating the infiltration of the liquid in the web when the web is not pressurized before the liquid is applied.

Hereinafter, the reason the liquid L can be infiltrated deeply in the web W2, and the interlayer peeling can be made unlikely to occur in the sheet S will be described. FIG. 3 is a view illustrating the infiltration of the liquid L in the web in the fiber body forming apparatus 100. FIG. 4 is a view illustrating the infiltration of the liquid L in the web W2 when the web W2 is not pressurized before the liquid L is applied. In addition, for the convenience of illustration, in FIGS. 3 and 4, the web W2 and the sheet S are shown thicker with respect to the pressure application portion 82 and the heating portion 84.

The liquid L ejected by the liquid application devices 102 is applied, as shown in FIG. 3, to one surface A1 and the other surface A2 of the web W2. In addition, the liquid L is infiltrated toward the inside from the surfaces A1 and A2 of the web W2. In the case shown in FIG. 3, compared to the case shown in FIG. 4, voids of the web W2 are small since the pressure is applied thereto by the pressure application portion 82, and for the infiltration of the liquid L in the web W2, a capillary phenomenon effectively works. Hence, the liquid L can be infiltrated deeply in the web W2, and the liquid L applied to the one surface A1 and the liquid L applied to the other surface A2 are brought into contact with each other. A time required from the application of the liquid L to the contact between the liquid L applied to the one surface A1 and the liquid L applied to the other surface A2 is determined depending on the thickness of the web W2 and is, for example, 100 microseconds to several seconds.

Subsequently, at the surfaces A1 and A2 of the web W2, water contained in the liquid L is evaporated. Hence, the surfaces A1 and A2 of the web W2 are more dried than the inside thereof. Furthermore, the rate of the mass of the liquid L to the mass of the fibers at the one surface A1 is decreased smaller than the rate of the mass of the liquid L to the mass of the fibers in the web W2, and the rate of the mass of the liquid L to the mass of the fibers at the other surface A2 is decreased smaller than the rate of the mass of the liquid L to the mass of the fibers in the web W2. Accordingly, an adhesion force F1 between the one surface A1 and one of the heating rollers 86 of the heating portion 84 is decreased smaller than a binding force F2 between the fibers in the web W2. Furthermore, an adhesion force F3 between the other surface A2 and the other heating roller 86 of the heating portion 84 is decreased smaller than the binding force F2. Hence, even when the web W2 is brought into contact with the heating rollers 86, the interlayer peeling is not likely to occur in the sheet S, and the web W2 can be prevented from winding around the heating rollers 86. Hence, the generation of jams can be prevented, and hence, the sheet S can be efficiently formed.

Furthermore, since the liquid L is infiltrated deeply in the web W2, the tensile strength of the sheet S can be increased, and the paper powder can be suppressed from being generated. Hence, when the sheet S is printed by an ink jet head, dot missing generated when the paper powder clogs a nozzle hole of an ink jet printer can be prevented.

On the other hand, as shown in FIG. 4, when the web W2 is not pressurized before the liquid L is applied thereto by liquid application devices 1102, the bulk density of the web W2 is low. Hence, voids of the web W2 is large, and in the infiltration of the liquid L in the web W2, the capillary phenomenon is not likely to occur. Accordingly, the liquid L is not infiltrated deeply in the web W2. Hence, an adhesion force F1 between the one surface A1 and one of heating rollers 1086 of a heating portion 1084 is increased larger than the binding force F2 between the fibers in the web W2. Furthermore, an adhesion force F3 between the other surface A2 and the other heating roller 1086 of the heating portion 1084 is increased larger than the binding force F2. Accordingly, when the web W2 is brought into contact with the heating rollers 1086, as shown in FIG. 4, the interlayer peeling is generated in the sheet S, and the winding of the web W2 around the heating rollers is generated.

In the fiber body forming apparatus 100, the binder contained in the liquid L is a thermoplastic resin or a thermosetting resin. Hence, in the fiber body forming apparatus 100, when the web W2 to which the liquid L is applied is heated, the fibers contained in the web W2 can be bound together.

The fiber body forming apparatus 100 includes the heating portion 84 which heats the web W2 to which the liquid L is applied by the liquid application devices 102. Hence, in the fiber body forming apparatus 100, when the web W2 to which the liquid L is applied is heated by the heating portion 84, the fibers contained in the web W2 can be bound together.

According to the fiber body forming apparatus 100, the liquid application device 102 is an ink jet head. Hence, in the fiber body forming apparatus 100, compared to the case in which the liquid application device is a roller, and the liquid is applied by the roller, the uniformity of the liquid thus applied is superior, and the web W2 can be prevented from being damaged. For example, when the liquid is applied using a roller, the web may be adhered to the roller in some cases, and the uniformity of the liquid L thus applied may be degraded in some cases. In addition, since the web W2 may be damaged, and/or the roller may be contaminated in some cases, the roller is required to be cleaned in some cases. By the application using the ink jet head, the problems as described above can be avoided.

Furthermore, according to the fiber body forming apparatus 100, since the liquid application device 102 is an ink jet head, compared to the case in which the liquid is applied by a spray, the liquid L can be efficiently applied. In the case of spray application, even if the liquid is sprayed from the spray, the amount of the liquid which is not tightly adhered to or not infiltrated in the web is large, and hence, the amount of the liquid to be sprayed is required to be larger than that actually applied to the web, so that the efficiency is inferior. Furthermore, in the case of the spray application, by the pressure of the spray, the web may be damaged in some cases. By the application using the ink jet head, the problems as described above can be avoided.

According to the fiber body forming apparatus 100, the liquid application devices 102 apply the liquid L to the web W2, the bulk density of which is preferably 0.80 g/cm$^3$ or less, more preferably 0.20 go 0.70 g/cm$^3$. Hence, by the fiber body forming apparatus 100, as described below in experimental examples, a sheet S in which the interlayer peeling is not more likely to occur can be formed.

2. FIBER BODY FORMING METHOD

Figure 5:
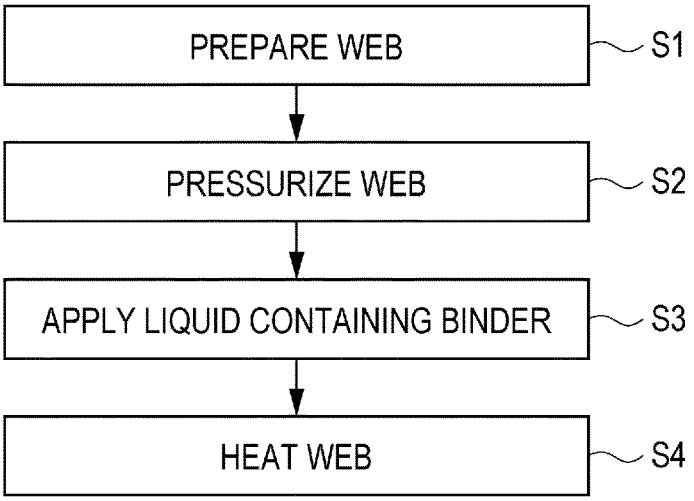
FIG. 5 is a flowchart illustrating a fiber body forming method according to this embodiment.

Next, a fiber body forming method according to this embodiment will be described with reference to the drawing. FIG. 5 is a flowchart illustrating the fiber body forming method according to this embodiment. The fiber body forming method according to this embodiment forms fibers, for example, using the fiber body forming apparatus 100.

First, as described in "1. Fiber Body Forming Apparatus", by using the fiber body forming apparatus 100, the web W2 containing fibers is prepared (Step S1).

Subsequently, by the pressure application portion 82, the web W2 is pressurized (Step S2). By this step, the bulk density of the web W2 is set to 0.09 g/cm$^3$ or more. By Steps S1 and S2, the web W2 which contains fibers and which has a bulk density of 0.09 g/cm$^3$ or more can be prepared.

Next, by the two liquid application devices 102, the liquid L containing the binder which binds fibers together is applied to the web W2 (Step S3). In this step, the liquid L is applied to the web W2, the bulk density of which is preferably 0.09 to 0.80 g/cm$^3$ and more preferably 0.20 to 0.70 g/cm$^3$. In this step, the liquid L is applied by an ink jet method.

Next, by the heating portion 84, the web W2 to which the liquid L is applied is heated (Step S4).

Besides the steps described above, the fiber body forming method according to this embodiment may include the steps described in "1. Fiber Body Forming Apparatus".

3. MODIFIED EXAMPLES OF FIBER BODY FORMING APPARATUS

3.1. First Modified Example

Next, a fiber body forming apparatus according to a first modified example of this embodiment will be described.

Hereinafter, in the fiber body forming apparatus according to the first modified example of this embodiment, points different from those of the above fiber body forming apparatus 100 according to this embodiment will be described, and description of points thereof similar to each other will be omitted. The same as described above may also be applied to the following fiber body forming apparatus according to each of a second to a sixth modified example of this embodiment.

According to the fiber body forming apparatus 100 described above, the binder contained in the liquid L is a thermoplastic resin or a thermosetting resin.

On the other hand, in the fiber body forming apparatus according to the first modified example, the binder contained in the liquid L is a water-soluble resin. As the water-soluble resin, for example, there may be mentioned a polyacrylamide, a poly(vinyl alcohol), a poly(vinyl pyrrolidone), a cellulose derivative, such as a carboxymethyl cellulose, a hydroxymethyl cellulose, or an agar, a starch such as dextrin, a gelatin, a glue, or a casein. In addition, a polyacrylamide, a poly(vinyl alcohol), and a poly(vinyl pyrrolidone) are each also a thermoplastic resin. The liquid L may contain at least one of those resins mentioned above.

In the fiber body forming apparatus according to the first modified example, by an adhesion force of the water-soluble resin, the fibers are bound together. The fiber body forming apparatus according to the first modified example may contain no heating portion 84. When water contained in the liquid L is evaporated, for example, by spontaneous drying, without providing the heating portion 84, the fibers can be bound together.

According to the fiber body forming apparatus according to the first modified example, since the binder contained in the liquid L is a water-soluble resin, the heating portion 84 may be not provided, and hence, the number of components can be reduced. However, when the web W2 to which the liquid L is applied is heated by the heating portion 84, the fibers can be more tightly bound together.

3.2. Second Modified Example

Figure 6:
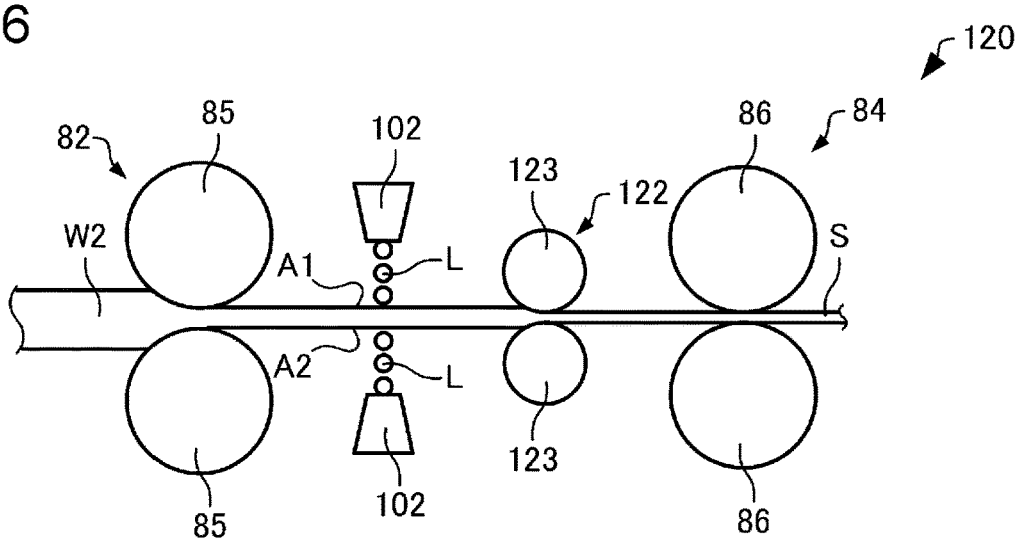
FIG. 6 is a schematic view showing a fiber body forming apparatus according to a second modified example of this embodiment.

Next, a fiber body forming apparatus according to the second modified example of this embodiment will be described with reference to the drawing. FIG. 6 is a schematic view showing a fiber body forming apparatus 120 according to the second modified example of this embodiment.

As shown in FIG. 6, since having a pressure application portion 122 which pressurizes the web W2 to which the liquid L is applied by the liquid application devices 102, the fiber body forming apparatus 120 is different from the fiber body forming apparatus 100.

The pressure application portion 122 is formed of a pair of calendar rollers 123 and sandwiches the web W2 at a predetermined nip pressure for pressure application. Since the web W2 is pressurized by the pressure application portion 122, the thickness thereof is decreased, and the bulk density of the web W2 is increased. One of the pair of calendar rollers 123 is a drive roller driven by a motor (not shown), and the other roller is a driven roller.

The pressure applied to the web W2 by the pressure application portion 122 is, for example, 30 to 1,000 kgf/cm$^2$ and preferably 200 to 700 kgf/cm$^2$.

The liquid application devices 102 are provided, for example, between the calendar rollers 85 of the pressure application portion 82 and the calendar rollers 123 of the pressure application portion 122. The diameter of the calendar roller 123 is smaller than the diameter of the calendar roller 85. Hence, the pressure application portion 122 can pressurize the web W2 by a large force as compared to that of the pressure application portion 82. Furthermore, since the diameters of the calendar rollers are decreased along a transport direction of the web W2, the calendar rollers 85 and 123 are prevented from slipping on the web W2.

Since the fiber body forming apparatus 120 includes the pressure application portion 122 which pressurizes the web W2 to which the liquid L is applied by the liquid application devices 102, the infiltration of the liquid L in the web W2 can be enhanced.

For example, in the web W2 pressurized by the pressure application portion 82, a so-called spring back phenomenon in which the bulk density is slightly decreased by a spring property of the fibers may occur. Furthermore, the bulk density of the web W2 to which the liquid L is applied is slightly decreased due to swelling of the fibers. Hence, the capillary phenomenon is not likely to occur, and the infiltration of the liquid L in the web W2 may be degraded in some cases.

According to the fiber body forming apparatus 120, even if the bulk density of the web W2 is decreased because of the spring back and the swelling of the fibers, the bulk density can be recovered by the pressure application portion 122. Hence, the infiltration of the liquid L in the web W2 can be more enhanced.

In addition, in the fiber body forming apparatus 100 shown in FIG. 2, the heating portion 84 may have a function of the pressure application portion 122. Accordingly, the heating portion 84 and the pressure application portion 122 may be commonly formed from one component, and hence, the number of components can be reduced.

3.3. Third Modified Example

Figure 7:
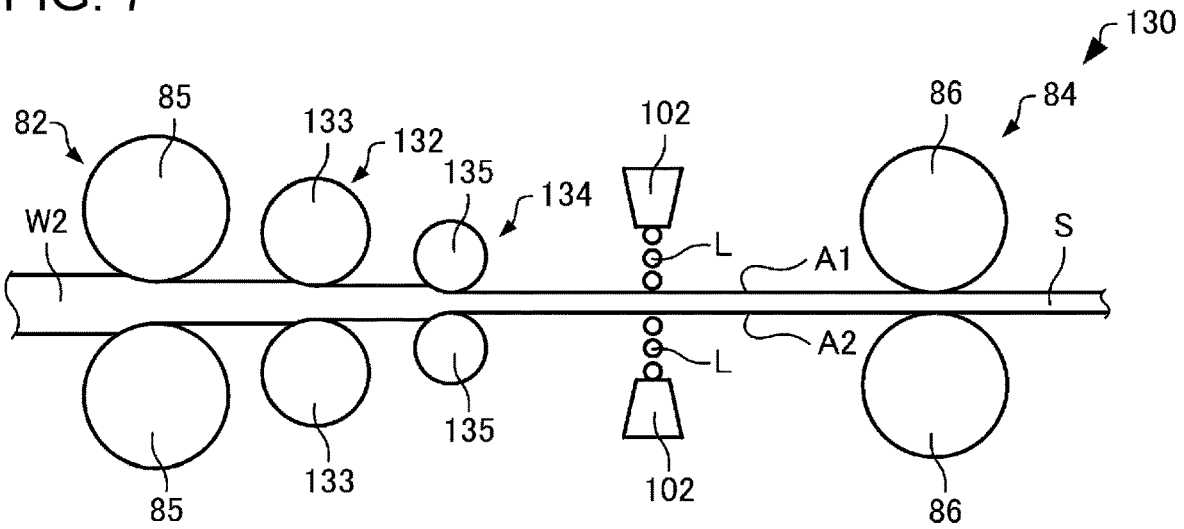
FIG. 7 is a schematic view showing a fiber body forming apparatus according to a third modified example of this embodiment.

Next, a fiber body forming apparatus according to the third modified example of this embodiment will be described with reference to the drawing. FIG. 7 is a schematic view showing a fiber body forming apparatus 130 according to the third modified example of this embodiment.

As shown in FIG. 7, since having pressure application portions 132 and 134 which pressurize the web W2, the fiber body forming apparatus 130 is different from the above fiber body forming apparatus 100.

The pressure application portion 132 pressurizes the web W2 pressurized by the pressure application portion 82. The pressure application portion 134 pressurizes the web W2 pressurized by the pressure application portion 132. The liquid application devices 102 apply the liquid L to the web W2 pressurized by the pressure application portion 134.

The pressure application portion 132 is formed of a pair of calendar rollers 133 and sandwiches the web W2 at a predetermined nip pressure for pressure application. Since the web W2 is pressurized by the pressure application portion 132, the thickness thereof is decreased, and the bulk density of the web W2 is increased. One of the pair of calendar rollers 133 is a drive roller driven by a motor (not shown), and the other roller is a driven roller.

The pressure application portion 134 is formed of a pair of calendar rollers 135 and sandwiches the web W2 at a predetermined nip pressure for pressure application. Since the web W2 is pressurized by the pressure application portion 134, the thickness thereof is decreased, and the bulk density of the web W2 is increased. One of the pair of calendar rollers 135 is a drive roller driven by a motor (not shown), and the other roller is a driven roller.

The diameter of the calendar roller 133 is smaller than the diameter of the calendar roller 85. Hence, the pressure application portion 132 can pressurize the web W2 by a large force as compared to that of the pressure application portion 82. The diameter of the calendar roller 135 is smaller than the diameter of the calendar roller 133. Hence, the pressure application portion 134 can pressurize the web W2 by a large force as compared to that of the pressure application portion 132. Furthermore, since the diameters of the calendar rollers are decreased along a transport direction of the web W2, the calendar rollers 85, 133, and 135 are prevented from slipping on the web W2.

The liquid application devices 102 are provided, for example, between the calendar rollers 135 of the pressure application portion 134 and the heating rollers 86 of the heating portion 84.

In addition, in the example shown in the drawing, although the fiber body forming apparatus 130 has the three pressure application portions 82, 132, and 134, the number thereof is not particularly limited. For example, the fiber body forming apparatus 130 may have no pressure application portion 134 or may have at least four pressure application portions.

3.4. Fourth Modified Example

Figure 8:
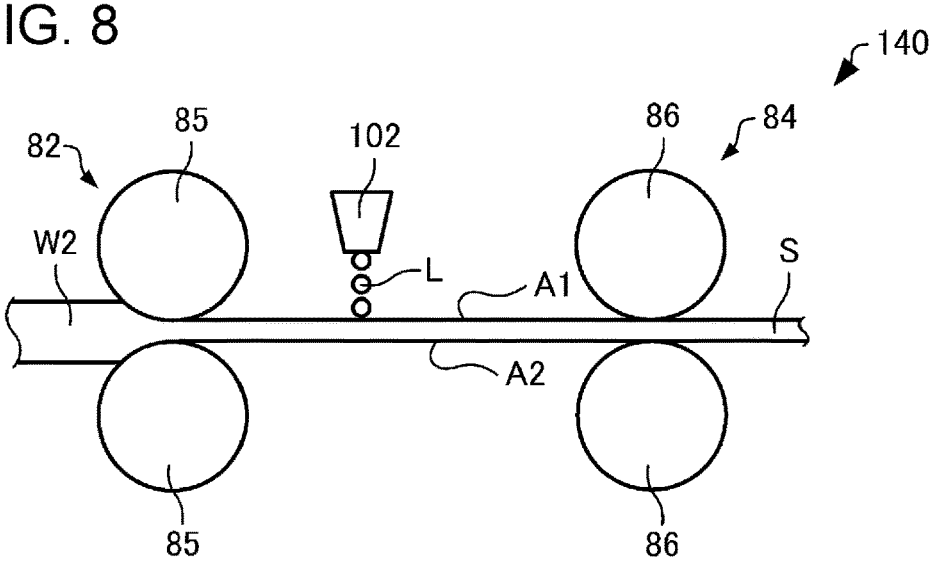
FIG. 8 is a schematic view showing a fiber body forming apparatus according to a fourth modified example of this embodiment.

Next, a fiber body forming apparatus according to the fourth modified example of this embodiment will be described with reference to the drawing. FIG. 8 is a schematic view showing a fiber body forming apparatus 140 according to the fourth modified example of this embodiment.

According to the fiber body forming apparatus 100 described above, as shown in FIG. 2, the two liquid application devices 102 are provided, one of the liquid application devices 102 is provided at one surface A1 side of the web W2, and the other liquid application device 102 is provided at the other surface A2 side of the web W2.

On the other hand, in the fiber body forming apparatus 140, as shown in FIG. 8, the liquid application device 102 is provided only at the one surface A1 side of the web W2. In the fiber body forming apparatus 140, compared to the case in which the two liquid application devices 102 are provided, the number of components can be reduced. However, in order to reliably infiltrate the liquid L to the other surface A2 of the web W2, as is the fiber body forming apparatus 100 described above, the two liquid application devices 102 are preferably provided.

3.5. Fifth Modified Example

Figure 9:
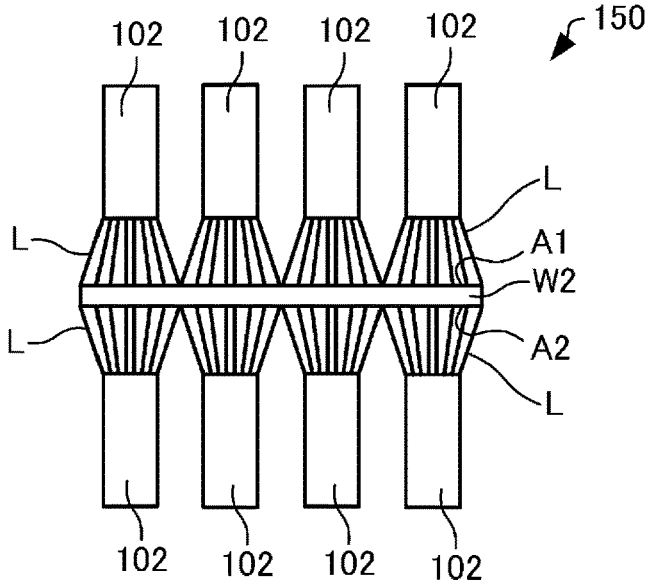
FIG. 9 is a schematic view showing a fiber body forming apparatus according to a fifth modified example of this embodiment.

Next, a fiber body forming apparatus according to the fifth modified example of this embodiment will be described with reference to the drawing. FIG. 9 is a schematic view showing a fiber body forming apparatus 150 according to the fifth modified example of this embodiment. In addition, FIG. 9 is a view when viewed along a transport direction of the web W2.

According to the fiber body forming apparatus 100 described above, the liquid application device 102 is an ink jet head.

On the other hand, in the fiber body forming apparatus 150, as shown in FIG. 9, the liquid application device 102 is a spray. Although the number of the liquid application devices 102 is not particularly limited, in the example shown in the drawing, four liquid application devices 102 are provided at the one surface A1 side of the web W2, and four liquid application devices 102 are provided at the other surface A2 side of the web W2. At the one surface A1 side, the four liquid application devices 102 are aligned in a width direction of the web W2, and at the other surface A2 side, the four liquid application devices 102 are also aligned in the width direction of the web W2. Accordingly, in the width direction of the web W2, the liquid L can be uniformly applied. In addition, the width direction of the web W2 is a direction orthogonal to the thickness direction of the web W2 and the transport direction of the web W2.

3.6. Sixth Modified Example

Figure 10:
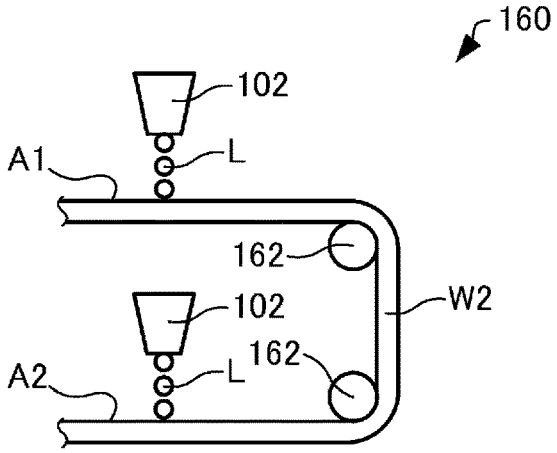
FIG. 10 is a schematic view showing a fiber body forming apparatus according to a sixth modified example of this embodiment.

Next, a fiber body forming apparatus according to the sixth modified example of this embodiment will be described with reference to the drawing. FIG. 10 is a schematic view showing a fiber body forming apparatus 160 according to the sixth modified example of this embodiment.

According to the fiber body forming apparatus 160, as shown in FIG. 10, the positions of the liquid application devices 102 are different from those of the fiber body forming apparatus 100.

In the fiber body forming apparatus 160, for example, first, one of the liquid application devices 102 applies the liquid L to the one surface A1 of the web W2, and subsequently, the other liquid application device 102 applies the liquid L to the other surface A2 of the web W2. The two liquid application devices 102 eject the liquid L, for example, in a gravity direction. Hence, the liquid L can be more reliably applied to the web W2.

For example, when at least one of the two liquid application devices 102 ejects the liquid L in a direction opposite to the gravity direction, by the action of the gravity, the liquid L may not be applied to the web W2 in some cases.

In the example shown in the drawing, after the web W2 is transported in a first direction, and the liquid L is applied to the one surface A1 thereof, the web W2 is transported in the gravity direction by two transport rollers 162 and is further transported in a second direction opposite to the first direction, and the liquid L is then applied to the other surface A2. The first direction and the second direction are each the horizontal direction.

Figures 11, 12:
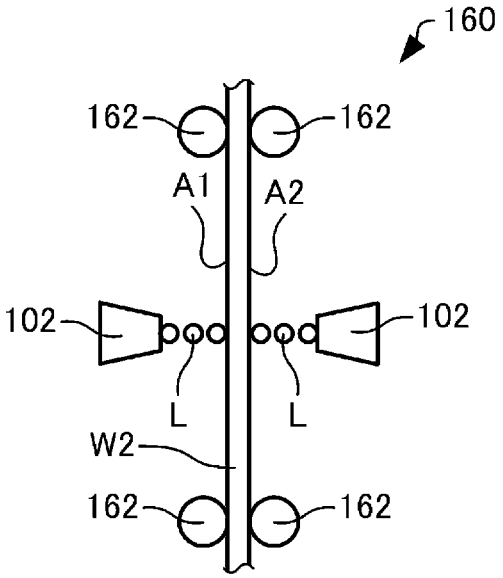
FIG. 11 is a schematic view showing a fiber body forming apparatus according to the sixth modified example of this embodiment.
FIG. 12 is a table showing compositions of liquids L1 to L3.

In addition, as shown in FIG. 11, the transport direction of the web W2 is the gravity direction, and the two liquid application devices 102 may eject the liquid L in a direction orthogonal to the gravity direction. In the case described above, the two liquid application devices 102 may simultaneously apply the liquid L to the web W2.

4. EXAMPLES AND COMPARATIVE EXAMPLES

Hereinafter, with reference to Examples and Comparative Examples, the present disclosure will be described in more detail. In addition, the present disclosure is not limited to the following Examples and Comparative Examples.

4.1. Examples 1 to 8 and Comparative Example 1

As Examples 1 to 8, by using a fiber body forming apparatus corresponding to the fiber body forming apparatus 100 shown in FIGS. 1 and 2, a sheet was formed. As a liquid application device, an ink jet head was used, and liquids L1 to L3 were each applied to two surfaces of a web. The application amounts of each of the liquids L1 to L3 was set to 9 g/m$^2$ on one surface of the web and 18 g/m$^2$ as the total application amount on the two surfaces of the web. The temperature of a heating portion was set to 150° C. As a raw material, recycled paper "G80" (manufactured by Mitsubishi Chemical Corporation) was used.

FIG. 12 is a table showing the compositions of the liquids L1 to L3. The unit of the numerical value in the table indicates percent by mass. With the balance being water, the total was set to 100 percent by mass. In the table, "PVA" represents a poly(vinyl alcohol", and PVA117 manufactured by Kuraray Co., Ltd. was used. PAM" represents a polyacrylamide, and DS4352 manufactured by Seiko PMC Corporation was used. "PU" represents a polyurethane, and SuperFlex 460 manufactured by DKS Co., Ltd. was used. "E1010" is Olefin E1010 manufactured by Nisshin Chemical Industry Co., Ltd.

In Examples 1 to 8, the pressure of the pressure application portion 82 was changed, and the bulk density of the web to which each of the liquids L1 to L3 was to be applied was changed. Except for that the pressure was not applied to the web by the pressure application portion, a sheet of Comparative Example 1 was the same as that of Example 1. An interlayer peeling test and a tensile strength test were performed on each of the sheets of Examples 1 to 8 and Comparative Example 1.

For the interlayer peeling test, by using a single sheet offset printing machine "3200CCD" manufactured by Ryobi Limited, monochromatic printing was performed at a rate of 6,000 sheets/hour on A4 size grain-short paper thus formed, and the number of sheets having interlayer peeling was counted when 200 sheets were printed. The evaluation criteria are as follows.

A: The number of sheets having interlayer peeling is 10 or less.

B: The number of sheets having interlayer peeling is 10 to less than 20.

C: The number of sheets having interlayer peeling is 20 to less than 30.

D: The number of sheets having interlayer peeling is 30 or more.

In the tensile strength test, by using a tensile tester "AGS-X 500N" manufactured by Shimadzu Corporation, the tensile strength of a sample having a width of 20 mm, which was obtained from the sheet thus formed by cutting, was measured by a method described in "JIS P8113: 2006". The evaluation criteria are as follows.

A: A tensile strength of 50 N or more.

B: A tensile strength of 35 to less than 50 N.

C: A tensile strength of 20 to less than 35 N.

D: A tensile strength of less than 20 N.

In addition, the bulk density of the web was obtained by the following formula based on a method described in "JIS P 8118.

$$\text{Bulk Density (g/cm}^3\text{)=basis weight (g/cm}^2\text{)/thickness (nm)}\times 1{,}000$$

FIG. 13 is a table showing the evaluation results of the interlayer peeling test and the tensile strength test of each of Examples 1 to 8 and Comparative Example 1.

As shown in FIG. 13, in Examples 1 to 8, compared to Comparative Example 1, the evaluations of the interlayer peeling test and the tensile strength test are superior. The reason for this is believed that in Examples 1 to 8, since the bulk density of the web is increased to 0.09 g/cm$^3$ or more by pressurizing the web using the pressure application portion 82, the capillary phenomenon is likely to occur as compared to that in Comparative Example 1, and the liquids L1 to L3 are each infiltrated deeply in the web. Furthermore, it is found that when the bulk density of the web is set to 0.09 to 0.80 g/cm$^3$ and preferably 0.20 to 0.70 g/cm$^3$, the evaluations of the interlayer peeling test and the tensile strength test are more improved. It is believed that in Example 6, since the bulk density is excessively high, and the capillary phenomenon is not likely to occur as compared to that in Example 5, the liquid L1 cannot be easily infiltrated deeply in the web, and the evaluation result is inferior to that of Example 5.

4.2. Examples 9 to 16 and Comparative Example 2

In each of Examples 9 to 16, by using a fiber body forming apparatus corresponding to the fiber body forming apparatus 150 shown in FIG. 9, a sheet was formed. As a liquid application device, a spray was used, and the liquids L1 to L3 were each applied to two surfaces of a web. The application amount of each of the liquids L1 to L3 was set to 40 g/m$^2$ on one surface of the web and was set to 80 g/m$^2$ as the total application amount on the two surfaces of the web. The temperature of a heating portion and a raw material were the same as those of Example 1.

In Examples 9 to 16, the pressure of the pressure application portion 82 was changed, and the bulk density of the web to which each of the liquids L1 to L3 was to be applied was changed. Except for that the pressure was not applied by the pressure application portion 82, a sheet of Comparative Example 2 was the same as that of Example 9. As Examples 1 to 8 and Comparative Example 1, the interlayer peeling test and the tensile strength test were performed on the sheet of each of Examples 9 to 16 and Comparative Example 2.

FIG. 14 is a table showing the evaluation results of the interlayer peeling test and the tensile strength test of each of Examples 9 to 16 and Comparative Example 2.

As shown in FIG. 14, compared to Comparative Example 2, in Examples 9 to 16, the evaluations of the interlayer peeling test and the tensile strength test are superior and basically have the same tendency as that shown in FIG. 13.

4.3. Examples 17 to 24 and Comparative Example 3

In each of Examples 17 to 24, by using a fiber body forming apparatus corresponding to the fiber body forming apparatus 120 shown in FIG. 6, a sheet was formed. The fiber body forming apparatus had a pressure application portion 82 (hereinafter, also referred to as "first pressure application portion" in some cases) which pressurized a web before the liquids L1 to L3 were each applied thereto and a pressure application portion 122 (hereinafter, also referred to as "second pressure application portion" in some cases) which pressurized the web after the liquids L1 to L3 were each applied thereto. The pressure of the second pressure application portion 122 was set to 500 kg/cm$^2$. As a liquid application device, an ink jet head was used, and the liquids L1 to L3 were each applied to two surfaces of the web. The application amount of each of the liquids L1 to L3 was set to 8 g/m$^2$ on one surface of the web and was set to 16 g/m$^2$ as the total application amount on the two surfaces of the web. The temperature of a heating portion and a raw material were the same as those of Example 1.

In Examples 17 to 24, the pressure of the first pressure application portion 82 was changed, and the bulk density of the web to which each of the liquids L1 to L3 was to be applied was changed. Except for that the web was not pressurized by the first pressure application portion 82, a sheet of Comparative Example 3 was the same as that of Example 17. As Examples 1 to 8 and Comparative Example 1, the interlayer peeling test and the tensile strength test were performed on the sheet of each of Examples 17 to 24 and Comparative Example 3.

FIG. 15 is a table showing the evaluation results of the interlayer peeling test and the tensile strength test of each of Examples 17 to 24 and Comparative Example 3. In addition, the "pressure" in the table indicates the pressure of the first pressure application portion 82.

As shown in FIG. 15, compared to Comparative Example 3, in Examples 17 to 24, the evaluations of the interlayer peeling test and the tensile strength test are superior and basically have the same tendency as that shown in FIG. 13.

In the present disclosure, within the range in which the features and the advantages of the present disclosure are obtained, the structure may be partially omitted, or the embodiments and the modified examples may be arbitrarily used in combination.

The present disclosure is not limited to the embodiments described above and may be variously changed or modified. For example, the present disclosure includes substantially the same structure as the structure described in the embodiment. The substantially the same structure includes, for example, the structure in which the function, the method, and the result are the same as those described above, or the structure in which the object and the effect are the same as those described above. In addition, the present disclosure includes the structure in which a nonessential portion of the structure described in the embodiment is replaced with something else. In addition, the present disclosure includes the structure which performs the same operational effect as that of the structure described in the embodiment or the structure which is able to achieve the same object as that of the structure described in the embodiment. In addition, the present disclosure includes the structure in which a known technique is added to the structure described in the embodiment.

What is claimed is:

1. A fiber body forming method comprising:

preparing a web which contains fibers and which has a bulk density of 0.09 g/cm$^3$ or more; and applying a liquid containing a binder to opposing sides of the web such that the binder binds the fibers together.

2. The fiber body forming method according to claim 1, wherein the binder is a thermoplastic resin or a thermosetting resin.

3. The fiber body forming method according to claim 1, wherein the binder is a water-soluble resin.

4. The fiber body forming method according to claim 1, further comprising heating the web to which the liquid is applied.

5. The fiber body forming method according to claim 4, wherein the heating is conducted at a temperature in the range of from 70° C. to 220° C.

6. The fiber body forming method according to claim 1, further comprising pressurizing the web to which the liquid is applied.

7. The fiber body forming method according to claim 1, wherein in the applying a liquid, the liquid is applied by an ink jet head.

8. The fiber body forming method according to claim 1, wherein in the applying a liquid, the web has a bulk density of 0.80 g/cm$^3$ or less.

9. The fiber body forming method according to claim 1, wherein in the applying a liquid, the web has a bulk density of 0.20 to 0.70 g/cm$^3$.

10. The fiber body forming method according to claim 1, wherein a content of the binder contained in the liquid is 10.0 percent by mass to 30.0 percent by mass.

11. A fiber body forming method comprising:

preparing a web which contains fibers;

pressurizing the web; and applying a liquid containing a binder to opposing sides of the pressurized web such that the binder binds the fibers together.

* * * * *